United States Patent [19]

Gonzalez et al.

[11] 4,104,426

[45] Aug. 1, 1978

[54] PRODUCTION OF MUFFLER MATERIAL

[75] Inventors: Rodolfo Gonzalez, Palos Verdes Estates; Allen P. Penton, III, Costa Mesa, both of Calif.

[73] Assignee: McDonnell Douglas Corporation, Long Beach, Calif.

[21] Appl. No.: 636,291

[22] Filed: Nov. 28, 1975

[51] Int. Cl.[2] ..... E04B 1/99; G10K 11/04

[52] U.S. Cl. ..... 428/36; 181/294; 181/227; 428/64; 428/289; 428/288; 428/401; 428/920

[58] Field of Search ..... 428/273, 720, 36, 64, 428/401, 289, 288; 181/33 G, 33 G A

[56] References Cited

U.S. PATENT DOCUMENTS

| | | | |
|---|---|---|---|
| 1,832,571 | 11/1931 | Nash | 428/241 |
| 2,731,359 | 1/1956 | Nicholson | 428/920 |
| 3,197,356 | 7/1965 | Campbell | 181/33 G |
| 3,616,123 | 10/1971 | Reynolds, Jr. et al. | 428/920 |
| 3,658,633 | 4/1972 | Jumentier et al. | 181/33 G A |
| 3,748,167 | 7/1973 | Lepor | 181/33 G A |
| 3,955,034 | 5/1976 | Fletcher et al. | 428/920 |
| 3,991,247 | 11/1976 | Grubb | 428/273 |

*Primary Examiner*—Brooks H. Hunt
*Attorney, Agent, or Firm*—Max Geldin

[57] ABSTRACT

Acoustical insulation or sound absorbing material particularly useful as automobile muffler material, having high temperature, vibration and chemical resistance, and of sufficient structural rigidity to resist packing or degradation when exposed to engine heat, vibration and exhaust gas pressures, formed of an alumina-silica ceramic fiber matt or blanket impregnated with a colloidal silica binder. The muffler acoustical and thermal insulation can be in the form of a hollow cylindrical body of alumina-silica fibers coated on its inside and outside surfaces and on its ends, with an aqueous colloidal silica sol, and the material dried.

9 Claims, 2 Drawing Figures

PRODUCTION OF MUFFLER MATERIAL

BACKGROUND OF THE INVENTION

Figure 1:
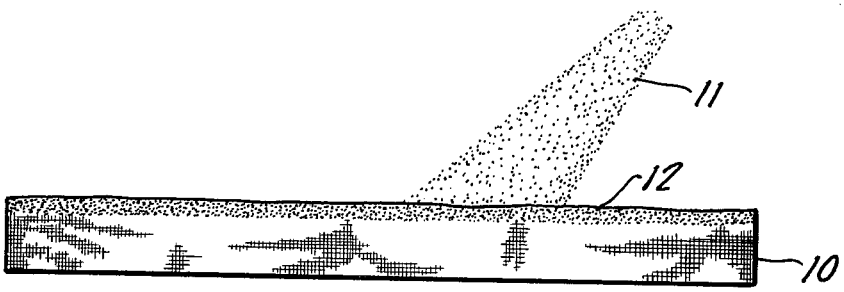

This invention relates to acoustical insulation material, and is particularly concerned with the production of an efficient muffler material especially adapted for automobile mufflers, which has improved properties of high temperature, vibration and chemical resistance, and which retains its structural configuration and rigidity to the hostile environment of automobile heat, vibration, and the gas pressures of automobile exhaust systems, over long periods of operation without substantial reduction in acoustical properties and without degradation or adverse affect on muffler performance.

Resin impregnated glass fiber insulation currently employed on automobile mufflers has the disadvantage of not being capable of withstanding muffler temperatures up to 1,500° F. Thus, automobile muffler materials presently employed generally have an upper temperature limit of the order of about 350° F.

U.S. Pat. No. 1,832,571 discloses a sound absorbing material formed of felt coated with granular particles such as pumice and a suitable binder such as casein glue.

U.S. Pat. No. 2,731,359 discloses a refractory fiber body formed of refractory fibers of alumina and silica coated with a silicon metal binder which is introduced into the fibrous body in the form of a slurry of fluid suspension in a suitable liquid medium, followed by firing at high temperatures in a non-oxidizing atmosphere of nitrogen or carbon monoxide to form a refractory inorganic silicon nitride or silicon carbide bond.

U.S. Pat. No. 3,359,717 discloses fibrous blends, particularly intimate cardable blends of inorganic fibers such as asbestos fibers and glass fibers, and including a drag agent such as colloidal silica to overcome the slipperiness of the fine glass particles. In addition to asbestos fibers, other inorganic fibers of a length too short to card, such as alumino-silicate fibers, are employed together with the fine glass fibers. The addition of the drag agent or colloidal silica is achieved by directing a spray of the liquid material over the fibers.

U.S. Pat. No. 3,002,862 discloses inorganic compositions comprising clay particles coated with a layer of silica, produced by mixing colloidal silica with a finely divided clay such as China clay, to form an electrically conductive composition.

U.S. Pat. No. 3,573,123 and 3,579,401 relate to high temperature resistant materials such as tapes containing carbon and silica, fabricated in cylindrical layers.

It is an object of the present invention to provide an efficient muffler material having good sound absorption characteristics, a particular object being the provision of a muffler material for automobiles which will withstand high temperatures of the order of 2,000° F while maintaining its structural integrity under vibration and in the presence of exhaust gas pressures and corrosive chemical components in the exhaust gas, over an extended period of operation, the muffler material being readily fabricated and being relatively inexpensive.

DESCRIPTION OF THE INVENTION

The above objects are achieved according to the invention by the provision of a sound absorption or acoustical insulation material for mufflers in the form of a refractory fibrous matrix of a specific composition impregnated with a specific refractory binder material to provide structural integrity at high temperatures.

The bonding agent is applied to the fibrous matrix at a binder to fibrous matrix ratio such as to provide the required structural properties without adversely altering the acoustical absorption properties.

More specifically, the muffler material is a ceramic fiber felt bonded with a silica binder to provide structural integrity. Particularly, the muffler material consists of an alumina-silica ceramic fiber matrix, e.g. in the form of a blanket or matt, which is coated or impregnated with a silica binder.

Both the alumina-silica fibers and the silica binder have temperature resistance in excess of 2,000° F, and the muffler material comprised of such ceramic fibrous matrix and silica binder has a temperature resistance of the order of about 2,300° F. The unbonded alumina-silica ceramic fiber does not have adequate structural integrity to resist gas pressures, vibrations and other exhaust system environments. By impregnating such ceramic fibers or felt with a colloidal silica binder it has been found that the resulting bonded felt matrix is strengthened sufficiently to resist the above hostile environmental factors, while at the same time providing substantially the same acoustical absorption effectiveness as in the case of the alumina-silica fibrous matrix per se and in the absence of the silica binder.

The felt or ceramic fiber matrix is comprised of fibers consisting essentially of silica and alumina. The proportions of silica and alumina in the fibers can vary, but preferably range from about 40 to about 50% alumina and about 50 to about 60% silica by weight. Thus, for example, such fibers can have the composition 54% $SiO_2$, 45% $Al_2O_3$, and traces of $Fe_2O_3$ and $Na_2O$. The fibers are preferably long fibers and preferably range from about ½ to about 2 inches in length. Commercially available alumina-silica ceramic fibers of the above noted composition have a diameter ranging from about 1 to about 10, e.g. about 3.5 microns, and are available as felts or matts in densities ranging from 3 to 8 lbs./cu.ft.

The silica employed for impregnating the alumina-silica fibrous felt or matrix is preferably colloidal silica in the form of an aqueous colloidal silica sol. The silica particles are preferably colloidally dispersed in an alkaline medium. The colloidal dispersion can contain silica particles of sizes ranging from about 10 to about 16 nanometers, preferably from 13 to 14 nanometers. A preferred colloidal silica material for this purpose are the aqueous colloidal silica sols marketed as "Ludox." A particularly effective colloidal silica of this type is "Ludox" HS 30 which is an aqueous alkaline colloidal silica sol containing approximately 30% $SiO_2$,0.29 to 0.39% $Na_2O$; and up to 0.15% sulfates as $Na_2SO_4$, and having a pH at 25° C of 9.65–10.15. The silica concentration of the latter aqueous colloidal silica sol can be adjusted to meet the required application of the muffler material, governed by the operating conditions and acoustical requirements. Thus, the concentration of the aqueous colloidal silica sol can range from about 3 to about 30% usually about 5 to about 20% silica, by weight. Where a concentration of this material less than 30%, e.g. 10 to 20% is desired, the above noted "Ludox" HS material can be diluted with water to the required silica concentration.

As previously noted, the colloidal silica sol is applied to the alumina-silica fibrous material by spraying, immersing or roller coating the fibrous matrix in the form of a blanket or matt, the particular mode of application depending on the amount of binder required to meet the operational requirements. The spray method is preferable for application where only surface impregnation or rigidizing is required. The binder content of the resulting silica bonded fibrous matrix or blanket can range from about 5 to about 50%, usually about 10 to about 40%, by weight. It has been found that moderate binder contents of say 10 to 30% e.g. 20%, by weight are adequate to provide the necessary reinforcement of the fibrous alumina-silica matrix, to prevent packing, expansion, blow outs and delaminations thereof when exposed to exhaust system conditions of certain preferred muffler designs. Increasing the silica binder content, particularly above 50% by weight, reduces the sound absorption properties of the resulting muffler material.

After the application of the aqueous colloidal silica binder to the alumina-silica fibrous felt or matrix, the resulting material is dried at ambient conditions of about 70° to about 75° F for a period of about 8 to about 24 hours. If shorter drying times are desired, the fibrous material to which the binder has been applied can be exposed to drying temperatures ranging from about 150° to about 300° F, e.g. about 250° F to 300° F. With increased drying temperature, the drying time can be reduced to about ½ to about 3 hours. Drying time will depend on felt or fibrous matrix density, the method of application of the binder, the concentration of the colloidal silica sol, and the degree of impregnation of the binder into the fibrous matrix which is desired. Generally, for use in automobile mufflers, the muffler material is formed into a hollow ring shaped or cylindrical configuration. In fabricating such cylindrical muffler materials according to the invention, a fibrous matt or blanket of the alumina-silica ceramic fibers is treated or contacted as by spraying with the aqueous colloidal silica sol, on one side of the matt while in the flat condition, to form a coating thereon, the sotreated matt is then wrapped around a mandrel with the treated or sprayed side against the mandrel to provide one or more ring shaped or cylindrical layers of the matt, which are held in place by means such as spirally winding a stainless steel wire around the assembly, the outside surface of the resulting cylindrical matt or blanket is then treated or contacted as by spraying, with the aqueous colloidal silica sol to thereby coat the outer surface with the binder, the mandrel is removed from the resulting matt cylinder, and the ends of such cylinder are then contacted, as by immersion, with the aqueous colloidal silica sol, followed by drying the resulting matt cylinder containing the impregnated binder under ambient or oven drying conditions.

Figure 2:
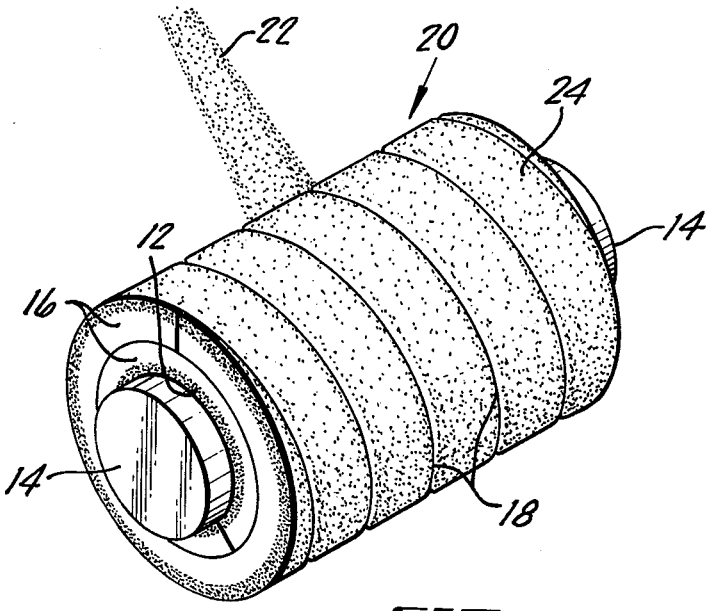

The following is an example of practice of the invention, such example only being illustrative and not limitative of the invention, taken in connection with the accompanying drawing wherein:

FIG. 1 illustrates a blanket of fibrous alumina-silica material treated as by spraying on one surface thereof with aqueous colloidal silica sol to form a binder coating thereon; and FIG. 2 illustrates the wrapping of the fibrous blanket containing the impregnated silica coating on one side thereof, around a mandrel to form a cylindrical fibrous blanket held in place by a spiral winding of stainless steel wire, and the spraying of the outside surface of the cylindrical fibrous blanket with aqueous colloidal silica sol to provide a binder coating on the outer surface of the cylindrical blanket.

An alumina-silica ceramic fiber matt or blanket, Johns Manville 2300, ½ inch thick, 4lb./cu. ft. density, indicated at 10 in FIG. 1 of the drawing, was sprayed on one side while in the flat condition, with a "Ludox" HS 30 aqueous colloidal silica sol diluted with water to a 10% silica sol, as indicated at 11. The binder was sprayed so as to obtain a maximum depth of binder to form a coating 12 of ⅛ inch thick.

The resulting fibrous blanket coated with the colloidal silica was then wrapped around a steel mandrel 14 of 1.75 inches in diameter, with the coating 12 against the mandrel. The blanket 10 was wrapped around the mandrel to provide two fibrous layers 16, and the wrapped cylinder blanket was held in place by spirally winding a stainless steel wire around the outer periphery of the fibrous blanket, as indicated at 18, with the spiral wire windings approximately 1 inch apart. The wire 18 was wrapped with sufficient tension to compress the blanket so that the total thickness of the two layers 16 was ⅞ inch thick, the blanket having a maximum outside diameter of 3½ inches. However, where the binder content of the initial coating applied to the fibrous matrix or blanket is sufficient to maintain the fibrous blanket in wrapped condition around the mandrel, the wire winding can be deleted.

When the steel wire 18 was secured in place around the cylindrical blanket 20 formed of the two layers 16, the outer side or outer periphery of the fibrous cylinder 20 was sprayed as indicated at 22, with the above 10% "Ludox" aqueous colloidal silica sol to a depth of ⅛ inch, to achieve a binder content of 10 to 20% by weight in the coated or impregnated portions 24 along the entire length of the cylinder.

The cylinder of fibrous alumina-silica material was then removed from the mandrel and the ends of the cylinder were immersed in a "Ludox" HS 30 aqueous colloidal silica sol diluted with water to a 20% silica sol, to provide a binder content of between about 30 to 40% at the ends of the cylinder. The binder concentration along the length of the fibrous cylinder and on both ends of the fibrous cylinder 20 provides a continuous coating which does not delaminate during handling or service.

The resulting alumina-silica fibrous cylinder 20 impregnated on both its inner and outer peripheral surfaces and at its ends with colloidal silica binder was allowed to dry at ambient temperature for about 8 hours, providing a continuous semi-porous coating. Alternatively, the binder impregnated fibrous cylinder 20 can be oven dried at temperatures up to 300° F.

The resulting muffler material formed of the alumina-silica blanket 20 impregnated with silica had a sound absorption greater than 40% at a frequency range from 125 to 2,000 Hz, a density of 6 lbs./cu. ft. and a temperature resistance of 2,300° F and above.

The density of the silica impregnated muffler material can range from about 3.5 to about 10 lbs./ cu. ft., depending on the density of the initial alumina-silica fibrous matrix and the silica binder content of the impregnated fibrous matrix.

From the foregoing, it is seen that there is provided according to the invention an efficient muffler material formed of an alumina-silica fibrous matrix impregnated with a silica binder which in addition to having efficient sound absorption characteristics, has a number of unique and advantageous properties including temperature resistance up to and above 2,300° F, resistance to vibration environments encountered in auto exhaust systems, and resistance to water, hydrochloric acid and sulfuric acid and other corrosive chemicals found in automobile exhaust systems. The muffler material also will not ignite at temperatures up to 2,300° F, has sufficient structural rigidity to resist packing or degradation when exposed to automobile heat, vibration, and gas pressures of automobile exhaust systems, has a weight loss not greater than 5% after 200 hours of automobile exhaust environments under normal highway or city driving conditions and acoustical properties which will not alter more than about 5% after 200 hours of normal automobile operating conditions, and such material will not degrade or adversely affect muffler performance after 200 hours of service.

Although the sound absorption or acoustical insulation material of the invention is particularly effective as a muffler material for automobiles, it can be employed also as a muffler material on other motor vehicles such as motorcycles, trucks and automobiles, and boats, in aerospace applications such as aircraft, missiles and boosters, and for other applications such as structural insulation in buildings.

While we have described particular embodiments of our invention for purposes of illustration, it will be understood that various changes and modifications can be made therein within the spirit of the invention, and the invention accordingly is not to be taken as limited except by the scope of the appended claims.

What is claimed is:

1. A muffler material having good sound absorption characteristics, high temperature and chemical resistance, and having structural rigidity when exposed to engine heat, vibration and exhaust gas pressures, consisting essentially of a ring shaped blanket of alumina-silica fibers impregnated along the inside and outside surfaces thereof, and on opposite ends thereof with a silica binder.

2. A muffler material as defined in claim 1, said alumina-silica fibrous blanket containing about 40 to about 50% alumina and about 50 to about 60% silica, by weight, the silica binder content of the coated or impregnated fibrous blanket ranging from about 5 to about 50% by weight.

3. A muffler material as defined in claim 2, said ring shaped blanket of alumina-silica fibers being cylindrical in shape, the silica binder content of the cylindrical fibrous blanket along the length thereof ranging from about 10 to about 20%, and at the ends thereof ranging from about 30 to about 40% silica binder by weight.

4. A muffler material as defined in claim 3, said impregnated binder concentration along the length of said cylindrical blanket and on both ends thereof providing a continuous semi-porous coating.

5. A muffler material having good sound absorption characteristics, high temperature and chemical resistance, and having structural rigidity when exposed to engine heat, vibration and exhaust gas pressures, consisting essentially of a ring shaped blanket of alumina-silica fibers coated or impregnated with a silica binder.

6. A muffler material as defined in claim 5, said alumina-silica fibrous blanket containing about 40 to about 50% alumina and about 50 to about 60% silica by weight.

7. A muffler material as defined in claim 5, the silica content of the coated or impregnated fibrous blanket ranging from about 5 to about 50%, by weight.

8. A muffler material as defined in claim 7, the silica binder content of the coated or impregnated fibrous blanket ranging from about 10 to about 40%, by weight.

9. A muffler material as defined in claim 8, said fibers having a length ranging from about ½ to about 2 inches, a diameter ranging from about 1 to about 10 microns, said fibrous blanket having a density ranging from about 3 to about 8 lbs./cu. ft.

* * * * *